US010280573B1

(12) United States Patent
Knapp

(10) Patent No.: US 10,280,573 B1
(45) Date of Patent: May 7, 2019

(54) BORING AND MILLING MACHINE FOR PAVED SLABS

(71) Applicant: Ronald A. Knapp, Bonita Springs, FL (US)

(72) Inventor: Ronald A. Knapp, Bonita Springs, FL (US)

( * ) Notice: Subject to any disclaimer, the term of this patent is extended or adjusted under 35 U.S.C. 154(b) by 229 days.

(21) Appl. No.: 15/236,577

(22) Filed: Aug. 15, 2016

Related U.S. Application Data

(60) Provisional application No. 62/203,665, filed on Aug. 11, 2015.

(51) Int. Cl.

| | |
|---|---|
| ***E01C 23/09*** | (2006.01) |
| ***E21B 10/02*** | (2006.01) |
| ***E21B 10/26*** | (2006.01) |
| ***E21B 12/00*** | (2006.01) |
| ***E01C 23/00*** | (2006.01) |
| ***E01C 23/088*** | (2006.01) |
| ***E01C 23/12*** | (2006.01) |
| *E21B 7/02* | (2006.01) |

(52) U.S. Cl.
CPC ..... *E01C 23/096* (2013.01); *E01C 23/00* (2013.01); *E01C 23/088* (2013.01); *E01C 23/122* (2013.01); *E21B 10/02* (2013.01); *E21B 10/26* (2013.01); *E21B 12/00* (2013.01); *E21B 7/02* (2013.01)

(58) Field of Classification Search
CPC .... E01C 23/06; E01C 23/088; E01C 23/0885; E01C 23/09; E01C 23/0906; E01C 23/094; E01C 23/0946; E01C 23/096; E01C 23/0966; E01C 23/12
USPC ..... 404/91, 101, 107; 299/36.1, 39.1, 39.2, 299/41.1
See application file for complete search history.

(56) References Cited

U.S. PATENT DOCUMENTS

| | | | |
|---|---|---|---|
| 1,839,588 | A | 1/1932 | Raymond |
| 2,621,898 | A | 12/1952 | Brodhead et al. |
| 2,719,698 | A | 10/1955 | Darin et al. |
| 2,743,904 | A | 5/1956 | Scott |
| 3,491,844 | A | 1/1970 | Kelly, Jr. |

(Continued)

FOREIGN PATENT DOCUMENTS

WO WO 2011/124887 A2 * 10/2011

OTHER PUBLICATIONS

CN 202416141U, China (Year: 2012).*

*Primary Examiner* — Sunil Singh
(74) *Attorney, Agent, or Firm* — Erickson Kernell IP, LLC; Kent R. Erickson

(57) ABSTRACT

A machine for boring holes into a slab includes a plurality of milling bits mounted on a distal end of a rotatable carrier and a coring bit slidably connected to the carrier such that the coring bit rotates with the rotating carrier and is slidable axially relative to the carrier. The coring bit cuts a relatively smooth bore into the solid medium whereas the milling bits create a bore with a relatively rough finish. An actuator engages the coring bit to adjust the depth of cut of the coring bit relative to the milling assembly depending on the desired finish of the hole to be bored. An undercut assembly is mounted on the carrier and selectively operable to form an undercut in the slab at the bottom of the hole so that a cured patch of material poured into the hole is restrained from working loose from the hole.

22 Claims, 13 Drawing Sheets

(56) References Cited

U.S. PATENT DOCUMENTS

| | | | | | |
|---|---|---|---|---|---|
| 4,078,622 | A | * | 3/1978 | Taylor-Myers | B24D 7/06 125/20 |
| 4,228,862 | A | | 10/1980 | Causse | |
| 4,968,101 | A | | 11/1990 | Bossow | |
| 5,460,231 | A | | 10/1995 | Collins | |
| 5,787,999 | A | | 8/1998 | Holte | |
| 5,947,634 | A | * | 9/1999 | Robillard | E01C 11/005 404/17 |
| 6,907,874 | B1 | | 6/2005 | Faircloth | |
| 7,757,780 | B2 | | 7/2010 | Pollock et al. | |
| 8,096,367 | B2 | | 1/2012 | McGivery | |
| 8,122,978 | B1 | | 2/2012 | Clifford | |
| 8,327,950 | B2 | | 12/2012 | Pollock et al. | |
| 2003/0007835 | A1 | | 1/2003 | Jurshak | |
| 2008/0100125 | A1 | | 5/2008 | Staples | |

* cited by examiner

BORING AND MILLING MACHINE FOR PAVED SLABS

CROSS-REFERENCE TO RELATED APPLICATIONS

This application claims the benefit of U.S. Provisional Patent Application No. 62/203,665, filed Aug. 11, 2015, the disclosure of which is hereby incorporated herein in its entirety by reference.

BACKGROUND OF THE INVENTION

Field of the Invention

The present invention is directed to a boring and milling machine for removing damaged sections of a paved slab for repair.

Background of the Invention

Existing equipment for repairing potholes 1 or small sections of degraded concrete in slabs 2 forming roads 3, runways, parking lots and the like are not optimal. A typical approach to repairing a pothole in a concrete slab is to cut a square hole around the pothole using a concrete saw. The specifications issued by most jurisdictions will not permit overlapping saw cuts when cutting the hole in the slab 2. The resulting saw cuts are therefore shallow at the corners and deeper toward the middle of each side of the hole formed. A jack hammer or chisel must then be used to chip away the concrete within the cuts made by the concrete saw. Use of a jack hammer to remove the concrete creates a considerable amount of dust and noise which may need to be abated.

Even when the square hole is properly formed, the concrete patch poured into the hole is prone to pop loose relatively quickly as traffic passes over the patch. Tires advancing transverse to or head on into the straight edge interface between the existing pavement and a patch is generally transmitted through the vehicle as a bump and when a vehicle passes transversely over multiple adjacent patched square holes, the successive bumps greatly diminish the comfort of the ride. In addition, the process for forming and cleaning the hole is time consuming and may require multiple skilled laborers utilizing a variety of equipment that has to be hauled from pothole to pothole to be repaired.

There remains a need for a system for expediting the process of making the necessary cuts through and boring the required holes into a section of slab to be removed from a concrete slab such as a road bed slab. There also remains a need for a patching process to create patches which are less prone to separate from the road and which are less likely to reduce the ridability of the section of road that is repaired.

SUMMARY OF THE INVENTION

The present invention is directed to a boring machine for boring holes into a solid medium such as concrete slabs. The boring machine includes a milling assembly including a first plurality of milling bits mounted on a distal end of a rotatable carrier. A coring bit is slidably connected to the rotatable carrier such that the coring bit rotates with the rotating carrier and is slidable axially relative to the rotatable carrier. The coring bit has an inner diameter that is greater than the diameter of an area circumscribed upon rotation of the first plurality of milling bits. The coring bit cuts a relatively smooth bore into the solid medium whereas the milling bits create a bore with a relatively rough finish. An actuator engages the coring bit to adjust the depth of cut of the coring bit relative to the milling assembly depending on the desired finish of the hole to be bored. If for example it is only necessary that the hole bored has a smooth finish near the surface, the coring bit may only be advanced into the medium an inch or two while the milling assembly is advanced further into the medium to create a deeper cut.

An undercut assembly is incorporated into the boring machine to form an undercut or wider diameter cut in the solid medium in spaced relation from the surface of the medium in which the hole is bored so that a patch of material poured into the hole is restrained from working loose from or popping out of the hole In one embodiment, the rotatable carrier is rotatably mounted on a hollow axle which is open at a distal end and through which a vacuum may be drawn. A vacuum conduit may extend through said axle with an open distal end of the vacuum conduit positioned above or rearward of the milling bits. A vacuum is drawn through the vacuum conduit to suck dust and debris from the milling and boring operation out from the hole. The coring bit functions in part as an enclosure forming a loose seal around the hole bored in the medium to contain the debris generated so that it may be vacuumed out of the hole. Water nozzles may also be mounted on the milling assembly or at other locations within to boring machine and connected to a water supply to direct water across the milling bits to lubricate and cool the milling bits and the coring bit and to entrain the dust and debris in a slurry. The slurry may then be vacuumed away through the vacuum conduit. Pressurized air may also be selective directed into the hole through the boring machine to assist in cleaning and drying the hole.

In one embodiment, the coring bit is mounted on a coring bit carrier which is normally biased by at least one spring to slide upward or rearward relative to the rotatable carrier and away from the milling assembly. An actuator engaging the coring bit carrier is selectively operable to push the coring bit carrier and the coring bit to slide downward or forward relative to the rotatable carrier and against the biasing force of the at least one spring.

The undercutting assembly may include at least one extendable milling bit connected to the rotatable carrier which is moveable between a retracted position and an extended position. In the extended position the path of rotation of the extendable milling bit extends wider than its path of rotation in the retracted position and beyond the path of rotation of the plurality of first milling bits and preferably wider than the outer diameter of the coring bit.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Figure 1:
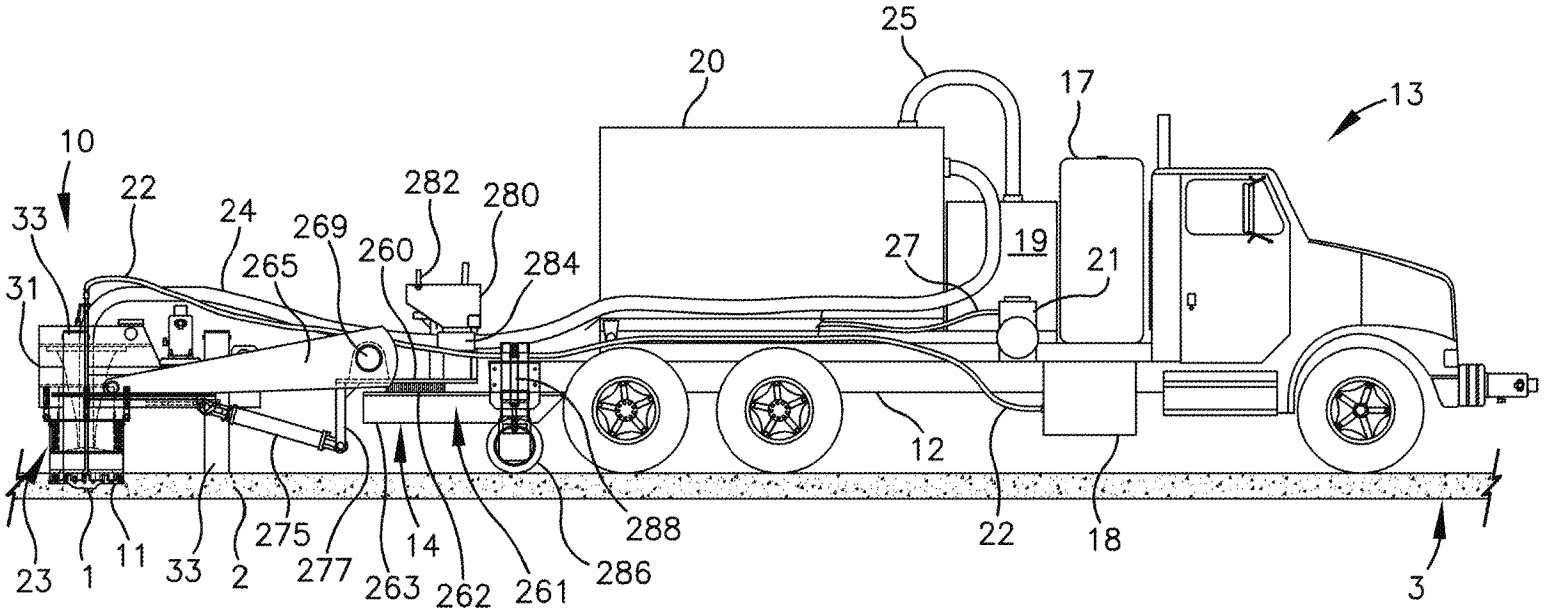
FIG. 1 is a side elevational view of a pavement boring machine connected to the frame of a truck by a positioning assembly and showing the boring machine in use boring a hole in the pavement around a pothole.

With initial reference to FIG. 1, the reference number 10 generally designates a pavement boring machine for boring a hole 11 into a section of a slab 2 for repairing potholes 1 in the slab 2. The slab 2 may form a lane of a road 3. The pavement boring machine 10 is shown connected to a frame 12 of a truck 13 by a positioning assembly 14. The positioning assembly 14 is adapted for raising and lowering the boring machine 10 relative to a slab 2 and truck frame 12 and for pivoting the boring machine relative to the truck frame 12 and about an axis extending perpendicular or vertically relative to the truck frame 12 as shown in phantom lines in FIG. 2.

When describing the boring machine 10 herein, directional references are generally made with reference to the direction of travel of the truck 13, to which the boring machine 10 is shown attached, along a lane of the road 3 in the intended direction of traffic thereon. In addition references to "horizontal" or "vertical" structure or features is intended to refer to the general orientation of the structure when the boring machine 10 is supported on a horizontal surface such as a slab 2 or lane of a road 3.

A water tank 17, water pump 18, vacuum generator or pump 19, waste holding tank 20 and air compressor 21 are also mounted on the truck frame 12. As will be described in more detail hereafter, the water pump 18 supplies water from the water tank 17, through water feed line 22, to the boring machine 10 for cooling the cutting and milling elements of a boring assembly 23 of the boring machine and capturing or entraining in a slurry the particles produced by the action of the boring assembly 23. A vacuum generated by the vacuum pump 19 then pulls the slurry, through a first vacuum line 24 to the waste holding tank 20. Vacuum pump 19 is connected to the waste holding tank 20 by a second vacuum line 25. Compressed air from compressor 21 may also be routed from a compressed air line 27 to the boring machine 10 for use in directing the slurry into the vacuum line 25 and for drying the milled concrete.

Referring to FIGS. 3-11, the boring machine 10 includes main frame 31 slidably mounted relative to four support legs 33. The boring machine 10 includes a milling head 35 and cylindrical coring bit 36 which are joined together, as discussed in more detail hereafter, to form the boring assembly 23 which is shown in an exploded view in FIG. 11. The boring assembly 23 is rotatably mounted relative to the main frame 31 and driven by a motor 38 which may be a hydraulic motor. The coring bit 36 surrounds the milling head 35 and is slidably mounted relative to the milling head 35 to permit the milling head 35 to bore deeper into a slab than the coring bit 36 if desired. The coring bit 36 provides a smoother finish on the hole it cuts than the milling head which may be desired or required for an initial part of hole to be formed but which may be unnecessary for lower portions of the bore.

In the embodiment shown, main frame 31 is formed from a lower beam 41 and upper beam 42 which may generally be described as H-beams. Lower beam 41 includes a central web 46 and side flanges 47 and 48. Upper beam 42 also includes a central web 51 and side flanges 52 and 53 but is preferably shorter than lower beam 41 as shown in FIGS. 4-7. Side flanges 52 and 53 of upper beam 42 are supported on the side flanges 47 and 48 respectively of lower beam 41 toward a distal or outer end of the lower beam 41 relative to its connection to positioning assembly 14.

The milling head 35 and coring bit 36 are mounted on a rotating drum 56. Rotating drum 56 is rotatably mounted on a hollow axle 58. Hollow axle 58 is connected at its upper end 59 to the underside of web 51 of upper beam 42 around an opening 61 formed therein and extends through an access hole 63 formed through the web 46 of lower beam 41. The drum 56 is rotatably mounted on the axle 58 by a bearing assembly 65 having an inner race 66 mounted around the axle 58 proximate a lower end thereof and an outer race 67 mounted on the inside of the drum 56 so that the drum 36 rotates about the axle 58. The bearing assembly 65 connects the drum 56 to the axle 58 below the web 46 of the lower beam 41.

A sprocket 71 is welded to the outer periphery of the drum 56. A chain 73 connects sprocket 71 to a drive sprocket 75 which is suspended below the central web 46 of the lower beam 41 on a drive shaft 76 which extends through a hole 77 in web 46. Drive shaft 76 is driven by drive motor 38 mounted to the main frame 31 on top of web 46. Motor 38 is used to rotate drum 56 and the milling head 35 and coring bit 36 connected thereto. Motor 38 and drive sprocket 75 are mounted on the web 46 of lower beam 41 towards a front or inner end of the boring machine 10.

The drum 56 and attached milling head 35 and coring bit 36 are raised and lowered relative to a slab 2 on which the boring machine 10 is supported on support legs 33 by raising and lowering the main frame 31 relative to the support legs 33. Support legs 33 are formed as tubes, and in the embodiment shown as square tubes, with a vertically extending slot 81 (see FIG. 9) formed on an inner face or side of each support leg 33. Four inner legs 84 are connected to the side flanges 47, 48, 52 and 53 of the lower and upper beams 41 and 42 by spacer plates 82 welded between the flanges 47, 48, 52 and 53 and the inner legs 84. The inner legs 84 have a narrower, mating geometry with and are slidably mounted within a respective support leg 33 with the spacer plates 82 extending through the slots 81. Hydraulic actuators 86 connected at their upper ends to the support leg 33 and at their lower ends to the inner legs 84 are operable in unison to raise and lower the inner legs 84, and the attached main frame 31, relative to the support legs 33 which are supported on the slab 2 in which a hole is to be bored.

Figure 10:
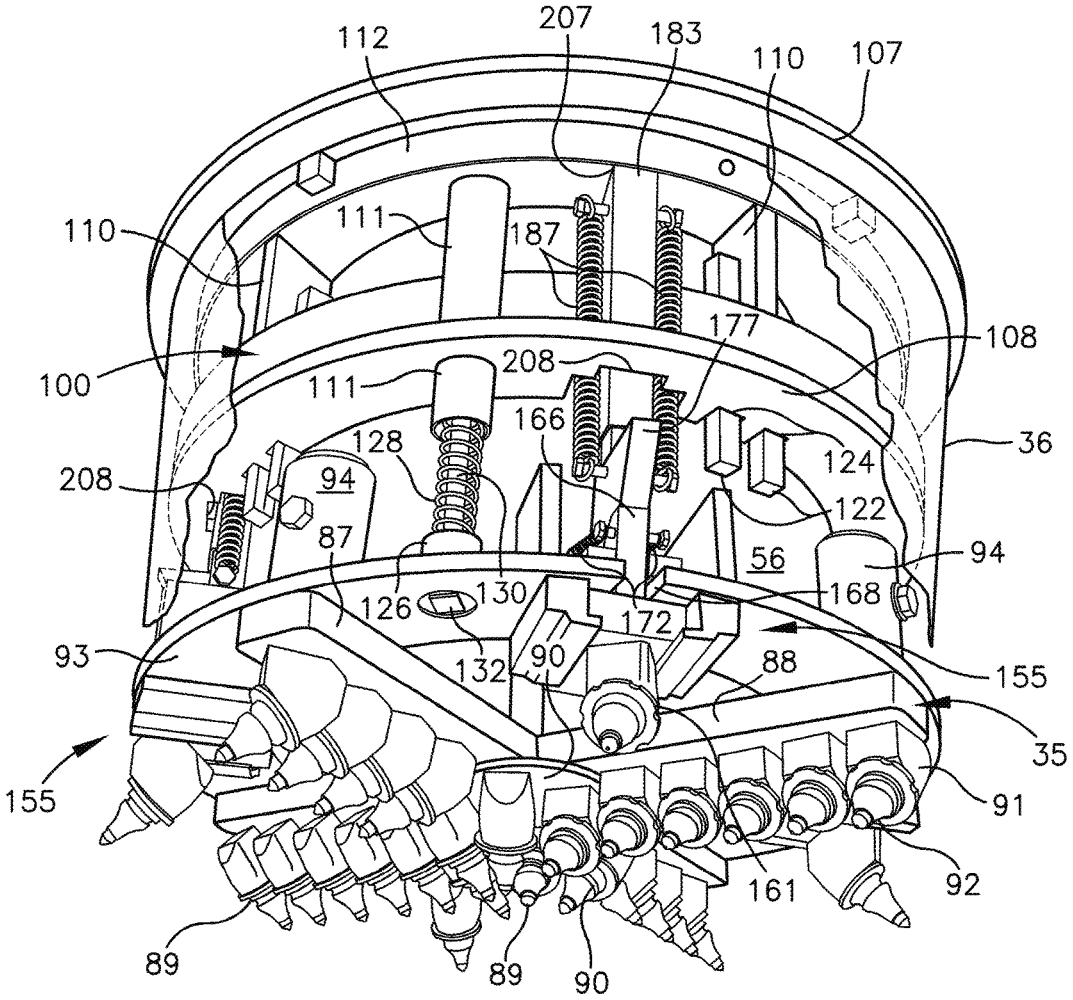
FIG. 10 is an enlarged perspective view of the boring assembly with portions of the coring bit removed to show detail.
Figure 11:
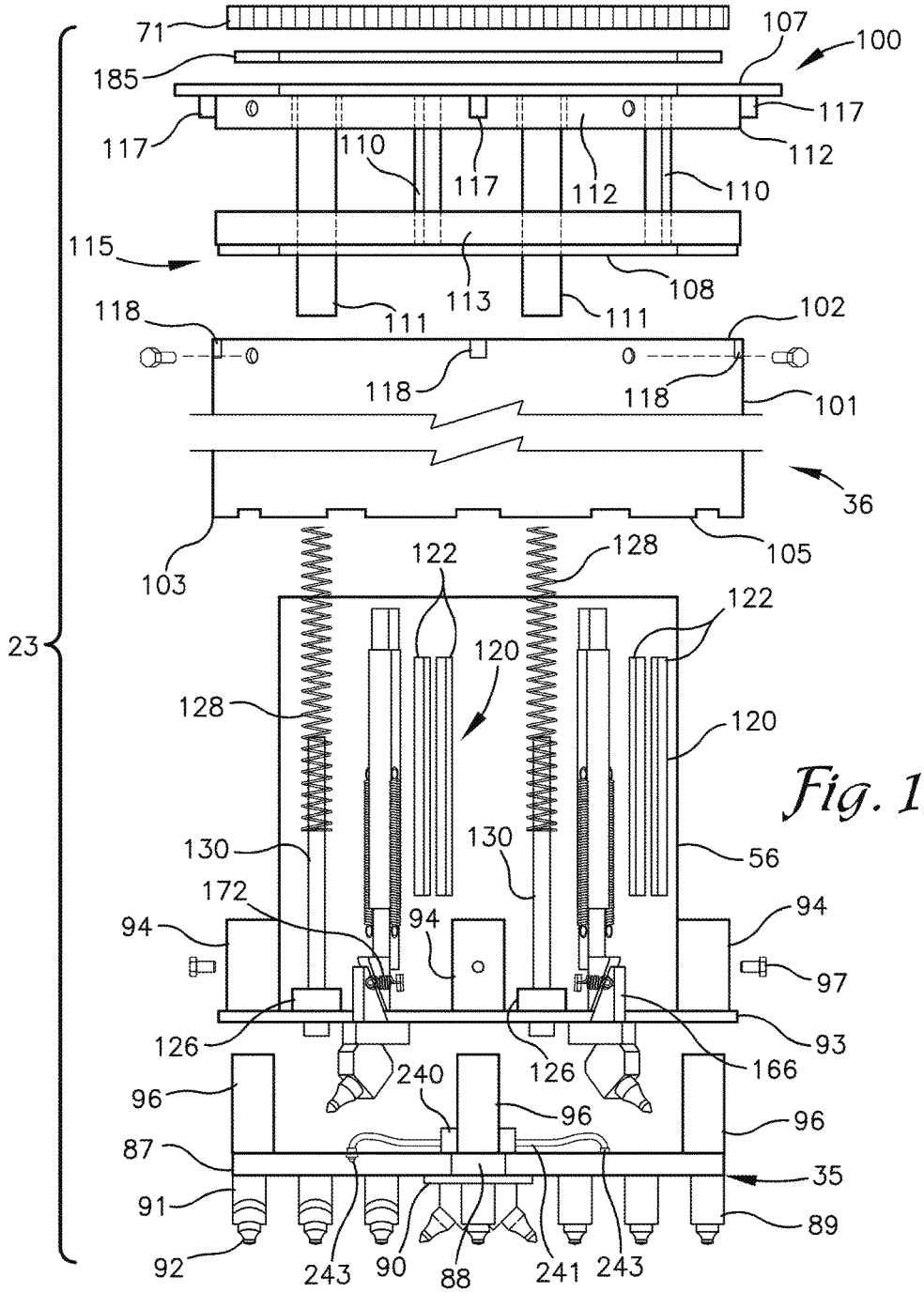
FIG. 11 is an enlarged and fragmentary, exploded, side elevational view of the boring assembly.

Referring to FIGS. 10 and 11, the milling head 35 comprises a support structure, such as first and second support arms 87 and 88, secured together to form a cross with a plurality of milling assemblies 89 mounted thereon in axial spaced relation. In the embodiment shown, the milling head 35 also includes a mounting disc 90 mounted to the center of the support arms 87 and 88 on the underside thereof. A plurality of milling assemblies 89, for example six, may be welded to the bottom of the mounting disc 90 in a circular pattern. The support arms 87 and 88 are mounted to the rotating drum 56 and extend across the bottom thereof. Each milling assembly 89 includes a base 91 and a milling bit 92. Each base 91 is welded to the bottom of one of the support arms 87 or 88 and the mounting disc 90 in a desired spacing and orientation and a bit 92 is mounted on each base in a desired orientation for milling. Bits 92 may be rotatably mounted relative to base 91. The spacing of milling assemblies 89 on the first and second support arms 87 and 88 may be established so that the point of contact of milling bits 92 on first support arm 87 extends between or in radially spaced relation from the point of contact of one or two of the milling bits 92 of the second support arm 88 so that the milling bits 92 on first support arm 87 transcribe paths in spaced relation and between or adjacent paths transcribed by the bits 92 or support arm 88 as the drum 56 rotates. The milling bits 92 are sized and spaced to generally span a substantial portion of the area circumscribed by the coring bit 36.

The support arms 87 and 88 are preferably removably mounted to the drum 56. In the embodiment shown, a milling head mounting flange 93 is mounted on the periphery of the drum 56 at a lower or distal end thereof. Four receivers 94 are mounted on an upper surface of mounting flange 93 in equally spaced radial alignment, ninety degrees apart and over receiver holes 95 (see FIG. 9 in which the milling head 35 has been removed) formed in the mounting flange 93. In the embodiment shown the receivers 94 are formed as cylindrical sleeves.

A mounting stem or post 96 is welded to an upper surface of each end of the milling head support arms 87 and 88 and extend upward therefrom. The mounting stems 96 are sized and positioned to extend through the receiver holes 95 in the mounting flange 93 and into the receivers 94 and then bolted or pinned therein to secure the milling head 35 to the drum 56. The milling head 35 is preferably readily removable from the drum 56 to allow replacement of the milling head 35 if bits 92 break and need repair or to replace worn bits while allowing continued use of the boring machine 10 while repairs or replacement of bits 92 is performed.

Once the milling head 35 is secured to the drum 56 its axial position relative to the drum 56 is fixed. The milling head 35 is advanced downward into the slab as it mills away material by lowering the main frame 31 relative to the support legs 33 using hydraulic actuators 86 as discussed previously.

The coring bit 36 is mounted on an annular, coring bit carriage 100 which is slidably connected to the drum 56 so that the coring bit 36 may slide axially relative the drum 56. The coring bit 36 includes a cylindrical wall 101 with upper and lower ends 102 and 103. Teeth 105 are formed in the lower end for grinding or cutting concrete as the coring bit 36 is rotated.

The coring bit carriage 100, in the embodiment shown, includes an upper, horizontally extending, annular drive flange 107 and a lower, horizontally extending annular support flange 108 connected together in vertically spaced relation by four, radially projecting vertical guide ribs 110 and four, vertically extending spring receiving tubes 111. Annular drive flange 107 and annular support flange 108 are each relatively flat with an inner diameter that is slightly wider than the outer diameter of drum 56 so that inner edges of flanges 107 and 108 may slide relative to the outer surface of drum 56. Inner edges of the vertical guide ribs 110 are preferably aligned with inner edges of flanges 107 and 108 and spaced slightly outward from the outer surface of drum 56. The outer diameter of annular drive flange 107 is greater than the outer diameter of annular support flange 108 and extends outward from an outer edge of each guide rib 110. The radial width of each guide rib 110 is approximately the same as the radial width of the annular support flange 108.

A relatively thin walled, cylindrical mounting collar 112, projects downward from approximately the middle of the drive flange 107 and is secured around the outer edges of the upper ends of the guide ribs 110. A relatively thin walled, cylindrical support collar 113 is secured around outer edges of the lower ends of the guide ribs 110 above the support flange 108. The guide ribs 110, mounting collar 112, support collar 113 and support flange 108 generally form a hub 115 on which the coring bit 36 may be secured. The coring bit 36 is slid onto hub 115 until an upper end 102 of the coring bit 36 abuts against a lower surface of drive flange 107. The upper end of the coring bit 36 is bolted to the mounting collar 112 through aligned bolt holes formed through the coring bit 36 and mounting collar 112. Alignment teeth or nubs 117 may be welded on an outer surface of the mounting collar 112 to mate with receivers or slots 118 formed in an upper end 102 of the coring bit 36 to ensure alignment of the bolt holes in the mounting collar 112 and coring bit 36. Engagement of the coring bit 36 by the alignment teeth 117 also provides a bearing point for rotating the coring bit 36 by the hub 115.

The guide ribs 110 extend into guide tracks 120 formed on an outer surface of the drum 56. Four guide tracks 120 are formed on the outer surface of the drum 56 and extend generally vertically when the central axis of the drum 56 is oriented vertically. The guide tracks 120 may also be described as extending in parallel axial alignment with the central axis of the drum 56. In the embodiment shown, each guide track 120 is formed by a pair of rods 122 which are square in cross-section and welded to an outer surface of the drum 56 in spaced apart relation. The spacing between the rods 122 is slightly wider than the width of the guide ribs 110 which are received in the space formed therebetween. Guide slots 124 are formed in the support flange 108 of the coring bit carriage 100 to allow the support flange 108 and the coring bit carriage to slide past the rods 122 forming the guide tracks 120.

The spring receiving tubes 111 are connected at upper ends to the underside of the drive flange 107, radially inward of the mounting collar 112, and extend through the support flange 108 spaced therebelow. The spring receiving tubes 111 are secured to the coring bit carriage 100 in equally spaced relation and in the embodiment shown are spaced ninety degrees apart. Four spring seating collars 126 are formed on or connected to an upper surface of the milling head mounting flange 93 in alignment with the four spring receiving tubes 111. A compression spring 128 is seated at a lower end within each spring seating collar 126 and extends upwards into the aligned spring receiving tube 111 and abuts at an upper end against the underside of the drive flange 107. A spring support rod 130 extends from the from the milling head mounting flange 93 within each seating collar 126 and upwards into the aligned spring receiving tube 111 inside of the respective coil spring 128 to restrain the springs 128 from becoming unseated from between the respective seating collars 126 and spring receiving tubes 128 through the gap extending therebetween. The spring support rods 130 and the spring seating collars 126 may be mounted on a threaded base 132 and secured in place in a threaded hole 133 formed through the milling head mounting flange 93 to facilitate assembly.

Figure 6:
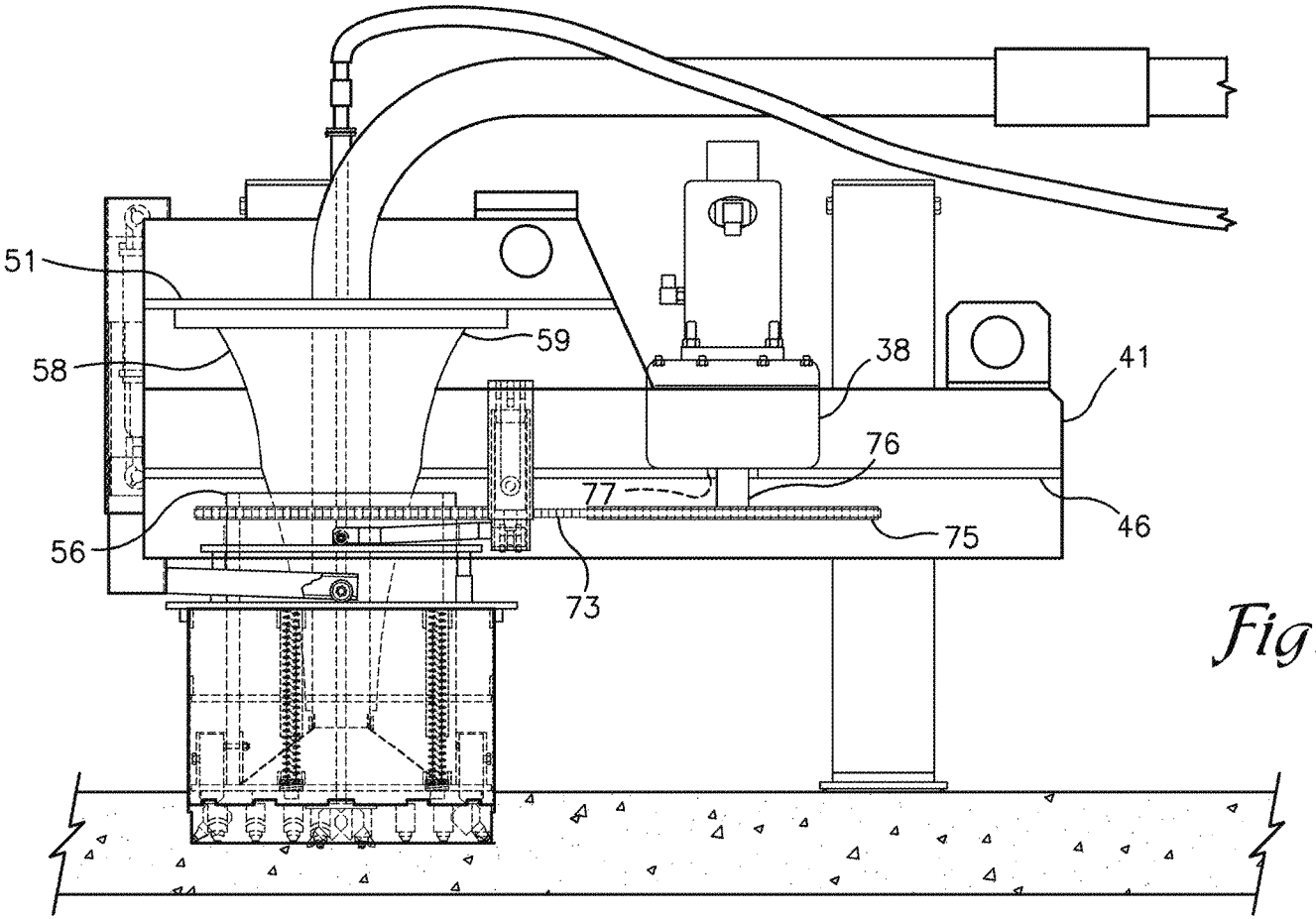
FIG. 6 is a view similar to FIG. 5 showing the milling head extending further into the slab than the coring bit.

Because the milling head mounting flange 93 is fixed to the drum 56, the compression springs 128 normally bias the coring bit carriage 100 and attached coring bit 36 upward relative to the drum 56 so that the lower end 103 and teeth 105 of the coring bit 36 are positioned above the bits 92 of the milling assembly 89. In the embodiment shown, when the coring bit carriage 100 is biased to the normal or uncompressed position, the lower end 103 of the coring bit 36 extends in alignment with the milling head support arms 87 and 88 and just above the base 91 of each milling assembly 89 as generally shown in FIG. 6.

Figure 5:
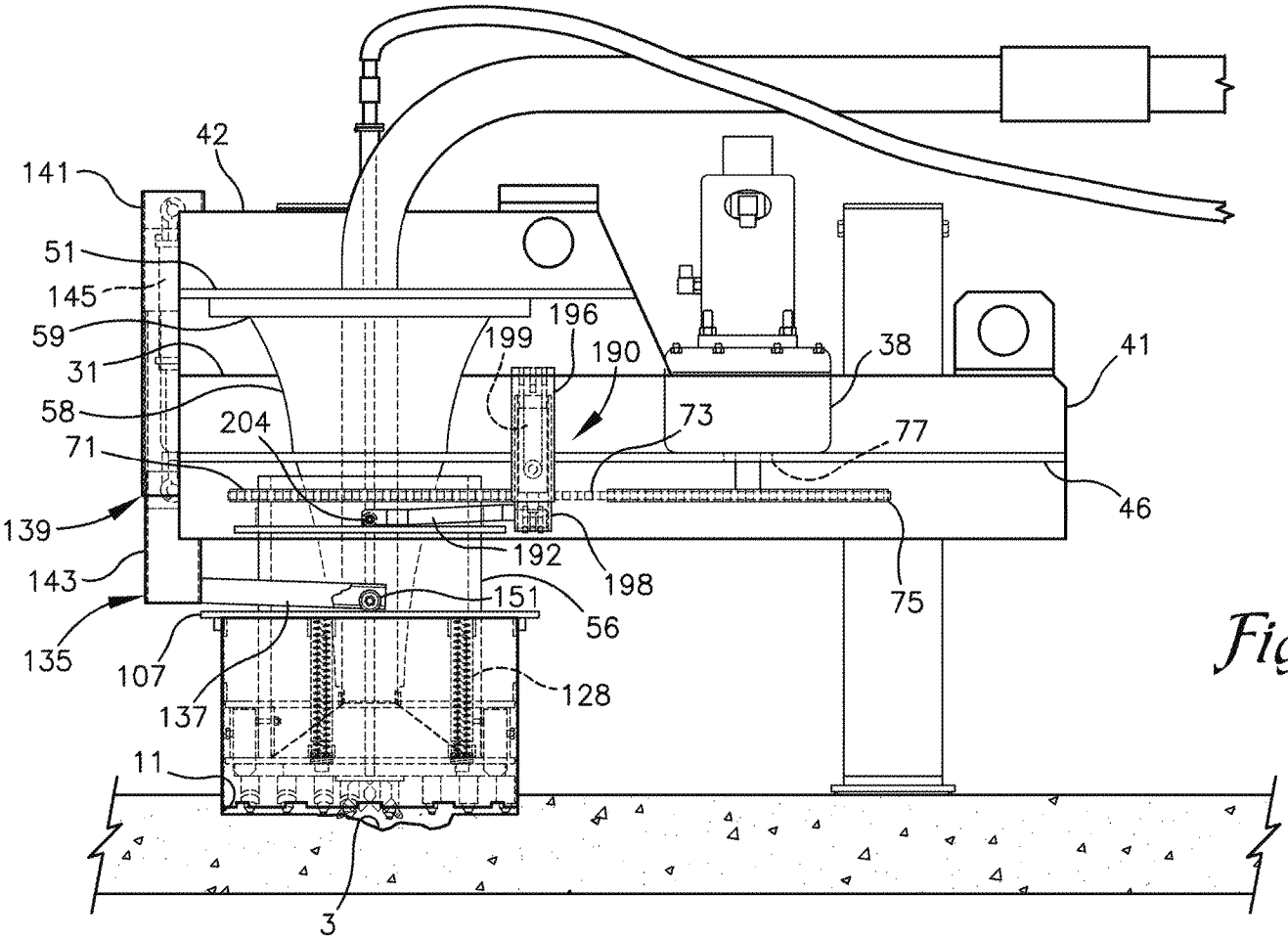
FIG. 5 is a side elevational view similar to FIG. 4 with the near support legs removed to show detail and with the boring assembly advanced downward into the slab with the coring bit and the milling head extending to approximately the same depth as the boring assembly bores a hole around the pothole in the slab.
Figure 12:
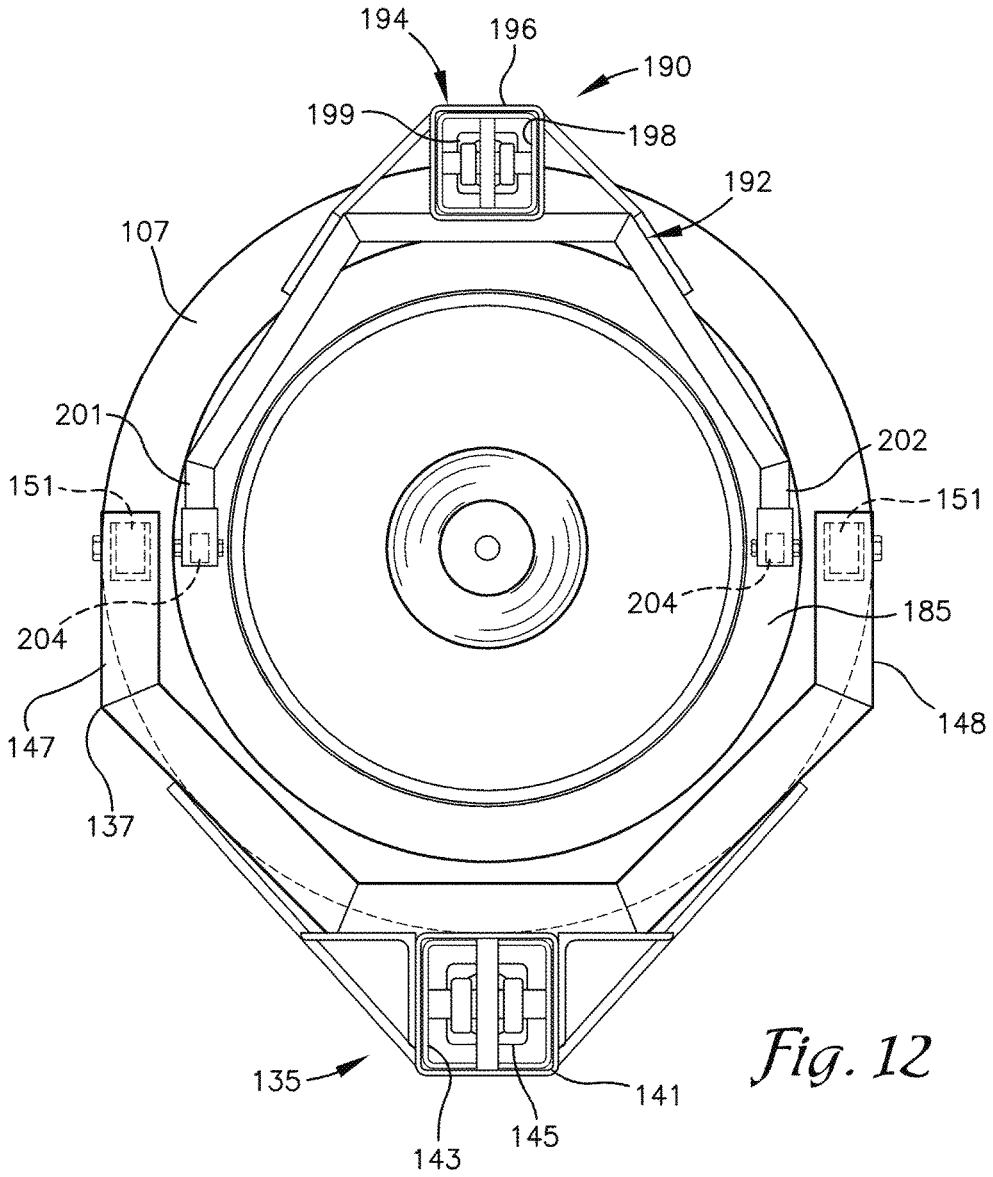
FIG. 12 is an enlarged and fragmentary cross-sectional view taken generally along line 12-12 of FIG. 7 and with portions removed to show details of a coring bit drive assembly and an undercutter actuating assembly.

With reference to FIGS. 5 and 12, a coring bit drive assembly 135, acting on the drive flange 107 of the coring bit carriage 100, is operable to advance or push the coring bit carriage 100 and attached coring bit 36 downward relative to the drum 56 and the attached milling head 35 against the biasing force of the springs 128. The coring bit drive assembly 135 includes a fork or yoke 137 mounted on a lower end of a telescoping arm assembly 139. The telescoping arm assembly 139 includes a stationary tube 141 mounted vertically on the distal end of the main frame 31. A telescoping tube 143 is slidably mounted within and extends out a lower end of the stationary tube 141. A linear actuator, such as hydraulic actuator 145 connected at an upper end to the stationary tube 141 and at a lower end to the telescoping tube 143 is operable to extend and retract the telescoping tube 143 relative to the stationary tube 141.

As best seen in FIG. 12, the coring bit drive yoke 137 is generally C-shaped and mounted on a lower end of the telescoping tube 143. Coring bit drive yoke 137 may be described as comprising two arms 147 and 148 extending outward from opposite sides of the telescoping tube 143 and in closely spaced relation over the drive flange 107 of coring bit carriage 100. A roller or roller bearing 151 is rotatably mounted on the distal end of each yoke arm 147 and 148 with a portion of the roller extending below each arm to engage and bear against an upper surface of the drive flange 107 of the coring bit carriage 100. Extension of the telescoping tube 143 pushes the yoke arms 147 and 148 downward against the drive flange 107 pushing the coring bit carriage 100 and coring bit 36 downward relative to drum 56 which will be rotating during a boring operation and against the biasing force of the compression springs 128.

Retraction of the telescoping tube 143 and coring bit drive yoke 137 towards a retracted position allows the compression springs 128 to push the coring bit carriage 100 and coring bit 36 upwards relative to drum 56. When the telescoping tube 143 and yoke 137 are fully retracted, the yoke 137 and the coring bit carriage 100 extend below the sprocket 71 on the outer surface of the drum 56 so as not to interfere with rotation of the drum 56.

Figure 3:
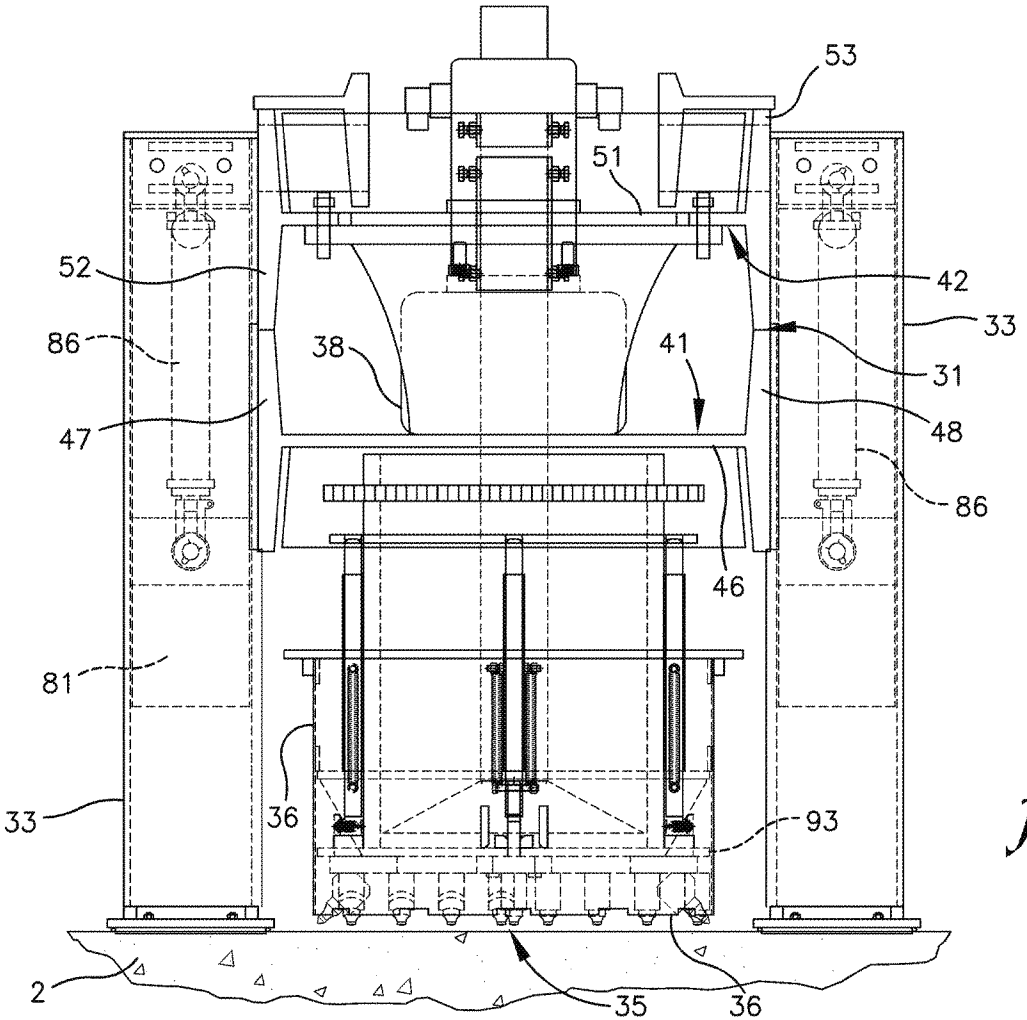
FIG. 3 is a rear end view of the pavement boring machine supported on a concrete slab with a coring but surrounding a milling head.
Figure 4:
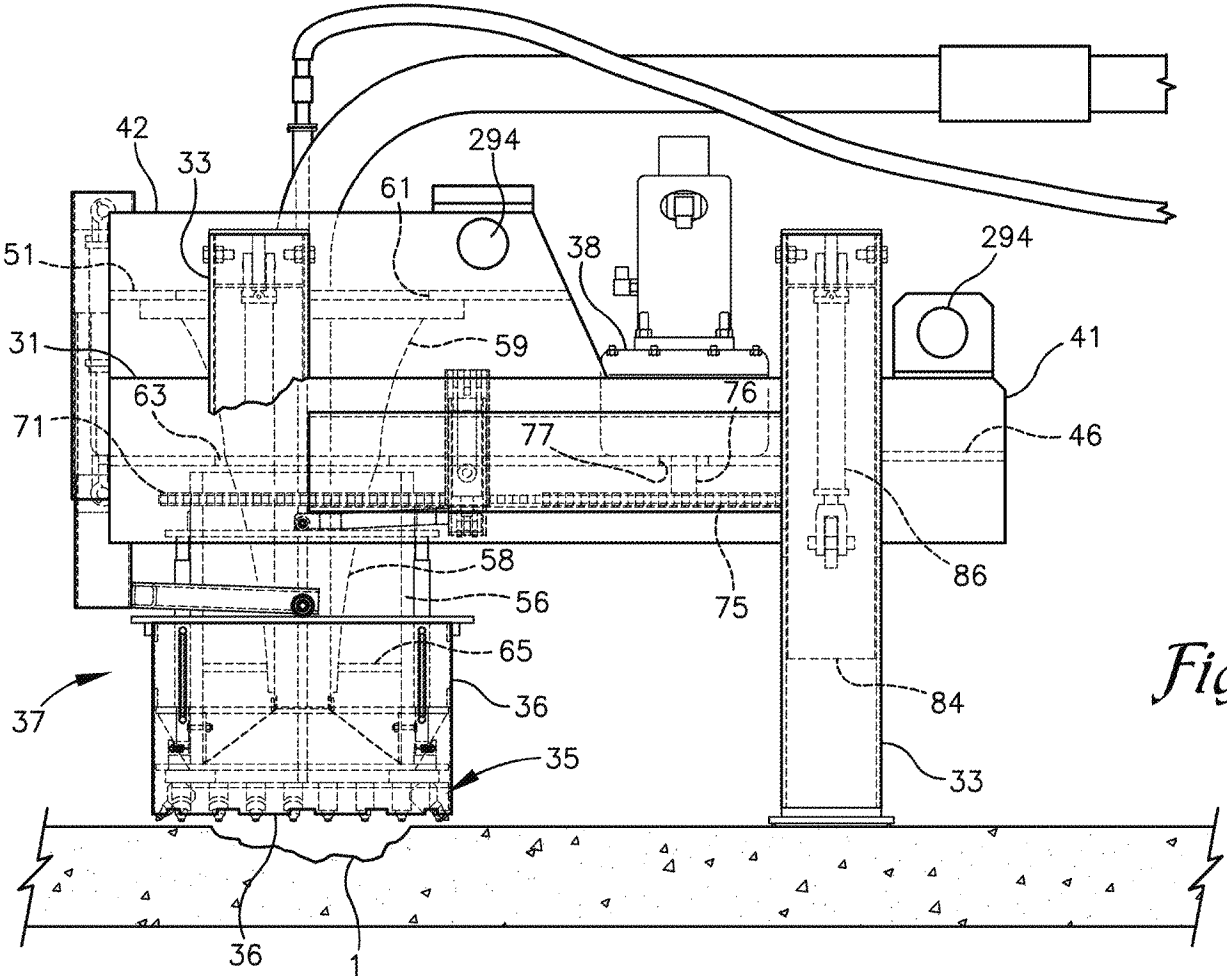
FIG. 4 is a side elevational view of the pavement boring machine supported on a concrete slab with a boring assembly positioned over a pot hole to be repaired with portions of a support leg removed to show detail.

At the beginning of a boring operation, the telescoping arm assembly 139 and attached coring bit drive yoke 137 are extended so that the lower end 103 of the coring bit 36 is lowered relative to the milling head 35 until the lower end 103 of the coring bit 36 extends in generally vertical alignment with the tips of the bits 92 of the milling assemblies 89 as generally shown in FIGS. 3-5. In such an alignment, the lower end 103 of the coring bit 36 and the tips of the bits 92 may be described as extending in the same, or a common, horizontal plane. While the drum 56 and attached milling head 35 and coring bit 36 are rotated, and with the coring bit 36 in a desired alignment with the milling assemblies 89, the main frame 31 is lowered relative to support legs 33 so that the bits 92 on the milling head 35 begin to mill or bore into the slab 2 and the teeth 105 of the coring bit cut a relatively clean cut around the periphery of the hole formed by the milling bits 92. The alignment of the lower end 103 of the coring bit 36 with the milling bits 92 may be maintained to any desired depth.

In some applications, it may be desired to provide a smooth peripheral edge of the bore formed in the slab only to a depth of one to two inches while the full depth of the bore is to extend six to eight inches into the slab. For such an application, once the coring bit 36 and the milling head 35 have bored downward approximately one to two inches, hydraulic pressure on the actuator 145 of telescoping arm assembly 139 is released so that the yoke 137 does not press the coring bit 36 downward any further as the rotating drum 56, and the attached milling head 35, are advanced further downward by lowering the main frame 31 relative to the support legs 33. As the rotating drum 56 and milling head 35 are advanced downward, the cylindrical coring bit 36 stays at the same level relative to the slab 2 while the drum 56 moves downward, sliding relative to the coring bit 36 and boring deeper into the slab 2 as shown in FIG. 6.

An undercutting assembly 155, as best seen in FIGS. 8-11, is incorporated into the boring machine 10 for use in forming an undercut 157 in the hole llformed by the boring machine 10. An undercut 157 is a portion of the hole 11 that is wider in diameter than a portion of the hole extending thereabove. Once the hole 11 is completed, hole 11, including undercut 157, is filled with concrete or other paving material and allowed to set forming a patch. The concrete that extends into the undercut 157 forms a lip which abuts against the portion of the slab 2 extending thereabove that was not removed by the boring machine 10 and therefore restrains the patch from popping out of the hole 11.

In the embodiment shown, the undercutting assembly 155 includes four extendable and retractable milling assemblies or undercutters 161 each of which comprises a milling assembly 89 mounted on a radially sliding mount 162. Each of the radially sliding mounts 162 is slidably mounted on the bottom of the milling head mounting flange 93 within opposed tracks or guide flanges 164 and in equally spaced relation or ninety degrees apart. Sliding mounts 162 may comprise a rectangular plate slidably mounted against the bottom of milling head mounting flange 93 and between guide flanges 164 (see FIG. 9). A milling assembly base 91 is mounted on the bottom of each mount 162 with the bit 92 extending at a desired angular orientation relative to the rotation of the drum 56 to engage the slab 2 when extended. Each sliding mount 162 also includes a wedge follower 166 projecting upward from an upper surface of the plate of mount 162 and through a radially outward opening guide slot 168 formed through the milling head mounting flange 93. The wedge follower 166 is mounted on mount 162 so that its wedge surface 170 slopes upward and outward relative to the milling head mounting flange 93. A pair of horizontally or radially extending tension springs 172 connected between an outer surface of the drum and the wedge follower 166 on opposite sides thereof normally draw each undercutter 161 to a retracted position in which the bit 92 does not extend radially past the path of rotation of the bits 92 of the outermost milling assemblies 89 on the milling head support arms 87 and 88.

The undercutting assembly 155 further comprises an undercutter actuator assembly 175 which generally functions as a plunger to engage the wedge followers 166 of each of the undercutters 161 and force the undercutters 161 outward against the spring force of the tension springs 172. Undercutter actuator assembly 175 includes four sets of drive wedges 177 each mounted on the lower end of a plunger 179. Each drive wedge 177 has an inwardly and downwardly sloping outer wedge surface 181 which is positioned against the outwardly and upwardly sloping wedge surface 170 of an associated wedge follower 166. Downward advancement of drive wedge 177 against wedge follower 166 forces wedge follower 166 and the undercutters 161 outward.

Each plunger 179 extends through a guide tube 183 welded or otherwise fixedly secured to an outer surface of the drum 56 in a vertical alignment. Upper ends of each plunger 179 are fixedly connected to an annular drive ring 185 which extends around the drum 56 above drive flange 107 of the coring bit carriage 100 and below the sprocket 71. A pair of vertically extending tension springs 187, connected between the guide tube 183 and the plunger 179 on opposite sides thereof, normally draw each of the plungers 179 and the drive wedges 177 upward and away from the wedge followers 167 which causes the undercutters 161 to be drawn to a retracted position by the radially extending tension springs 172 acting on the wedge followers 166.

Undercutter actuator assembly 175, which rotates with drum 56, is driven by a undercutter actuator drive assembly 190 acting on drive ring 185 and is similar in construction to the coring bit drive assembly 135. Undercutter actuator drive assembly 190 includes a fork or yoke 192 mounted on a lower end of a telescoping arm assembly 194. The telescoping arm assembly 194 includes an outer, stationary tube 196 mounted vertically on the near end of the main frame 31. A telescoping tube 198 is slidably mounted within and extends out a lower end of the stationary tube 196. A linear actuator, such as hydraulic actuator 199 connected at an upper end to the stationary tube 196 and at a lower end to the telescoping tube 198 is operable to extend and retract the telescoping tube 198 relative to the stationary tube 196.

The undercutter actuator drive yoke 192 is generally C-shaped and mounted on a lower end of the telescoping tube 198. Undercutter actuator drive yoke 192 may be described as comprising two arms 201 and 202 extending outward from opposite sides of the telescoping tube 198 and in closely spaced relation over the drive ring 185 of undercutter actuator assembly 175. A roller or roller bearing 204 is rotatably mounted on the distal end of each yoke arm 201 and 202 with a portion of the roller extending below each arm to engage and bear against an upper surface of the drive ring 185 of the undercutter actuator assembly 175. Extension of the telescoping tube 198 pushes the yoke arms 201 and 202 downward against the drive ring 185 pushing the undercutter actuator assembly 175 downward relative to drum 56 and against the biasing force of the plunger tension springs 187. Downward advancement of the undercutter actuator assembly 175 forces the drive wedges 177 downward against the wedge followers 166 with the wedge surface 181 of each drive wedge 177 acting on the wedge surface 170 of each wedge follower 166 to urge or extend the extendable milling assemblies 161 outward such that the bits 92 of the milling assemblies 89 associated therewith extend past the path of rotation of the bits 92 on the outermost milling assemblies 89 on the milling head support arms 187.

Figure 8:
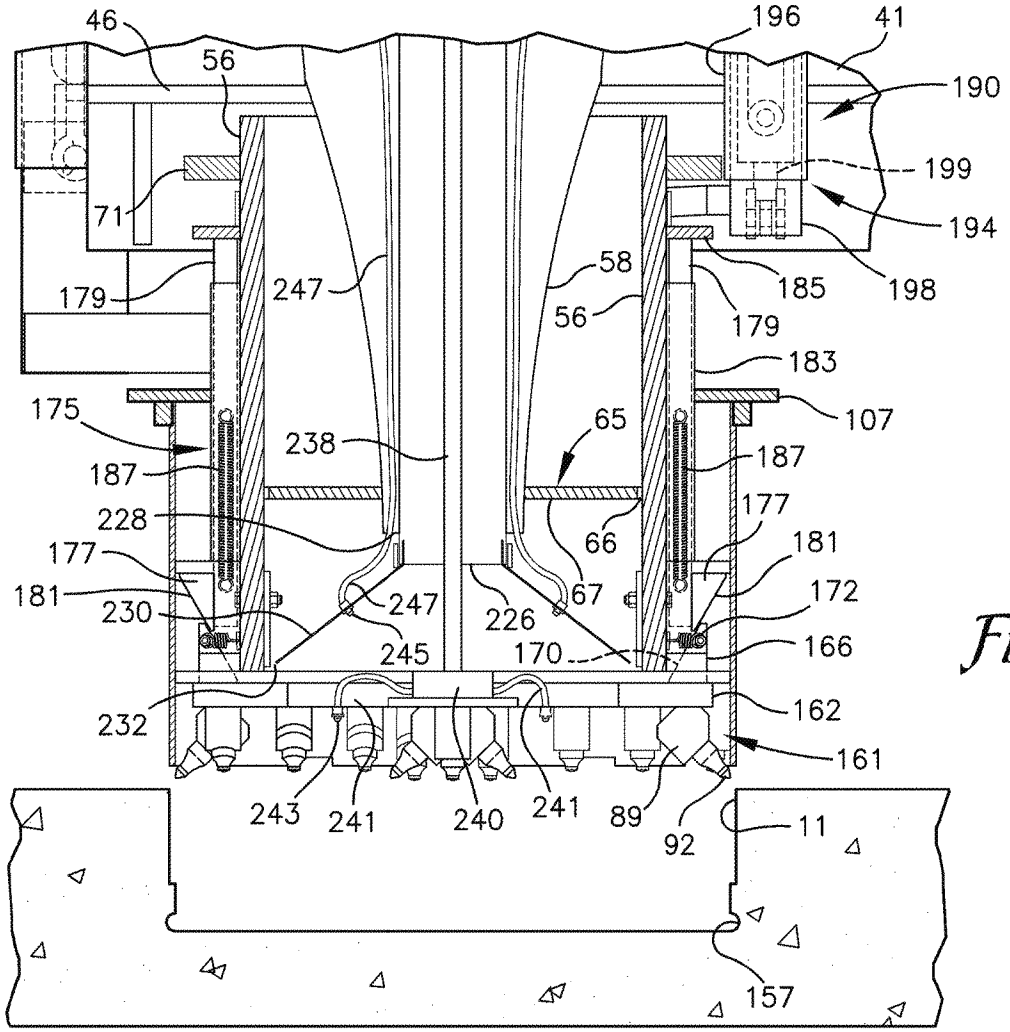
FIG. 8 is an enlarged and fragmentary cross-sectional view of the boring machine taken generally along line 8-8 of FIG. 2.
Figure 9:
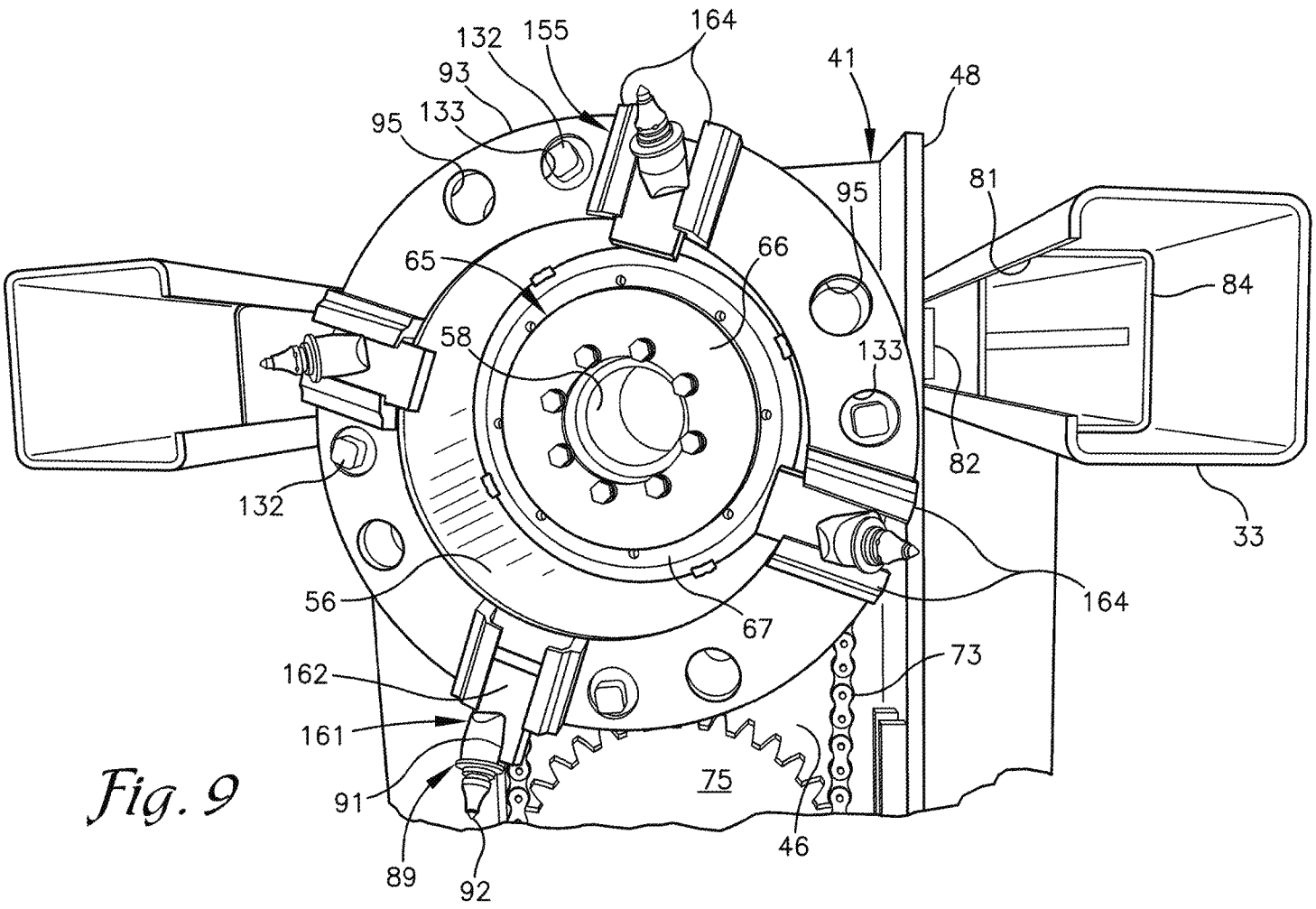
FIG. 9 is a fragmentary, bottom perspective view of the boring assembly with the coring bit removed to show detail.

Referring to FIG. 8, retraction of the telescoping tube 198 and undercutter actuator drive yoke 137 towards a retracted position allows the plunger tension springs 187 to pull or draw the undercutter actuator assembly 175 including plungers 179, drive wedges 177 and drive ring 185 upward relative to drum 56. Upward movement of the drive wedges 177 away from wedge followers 166 allows the springs 172 to draw the slidable undercutters 161 inward until the path of rotation of the bits 92 associated therewith do not extend past the path of rotation of the bits 92 on the outermost milling assemblies 89 on the milling head support arms 187.

Referring to FIG. 10, appropriately sized and shaped passageways or openings 207 are formed in the drive flange 107 of the coring bit carriage 100 through which the plunger guide tubes 183 extend to allow the drive flange 107 to slide over the guide tubes 183 as the coring bit carriage 100 slides relative to the drum 56 as discussed previously and for the undercutter actuator assembly 175 to slide relative to the coring bit carriage 100 when the undercutters 161 are extended or retracted. Similarly, appropriately sized and shaped passageways or openings 208 are formed in the support flange 108 of the coring bit carriage 100 and through which the plunger guide tubes 183 and plunger tension springs 187 extend to allow the support flange 108 to slide over the guide tubes 183 as the coring bit carriage 100 slides relative to the drum 56 as discussed previously and for the undercutter actuator assembly 175 to slide relative to the coring bit carriage 100 when the undercutters 161 are extended or retracted.

Figure 7:
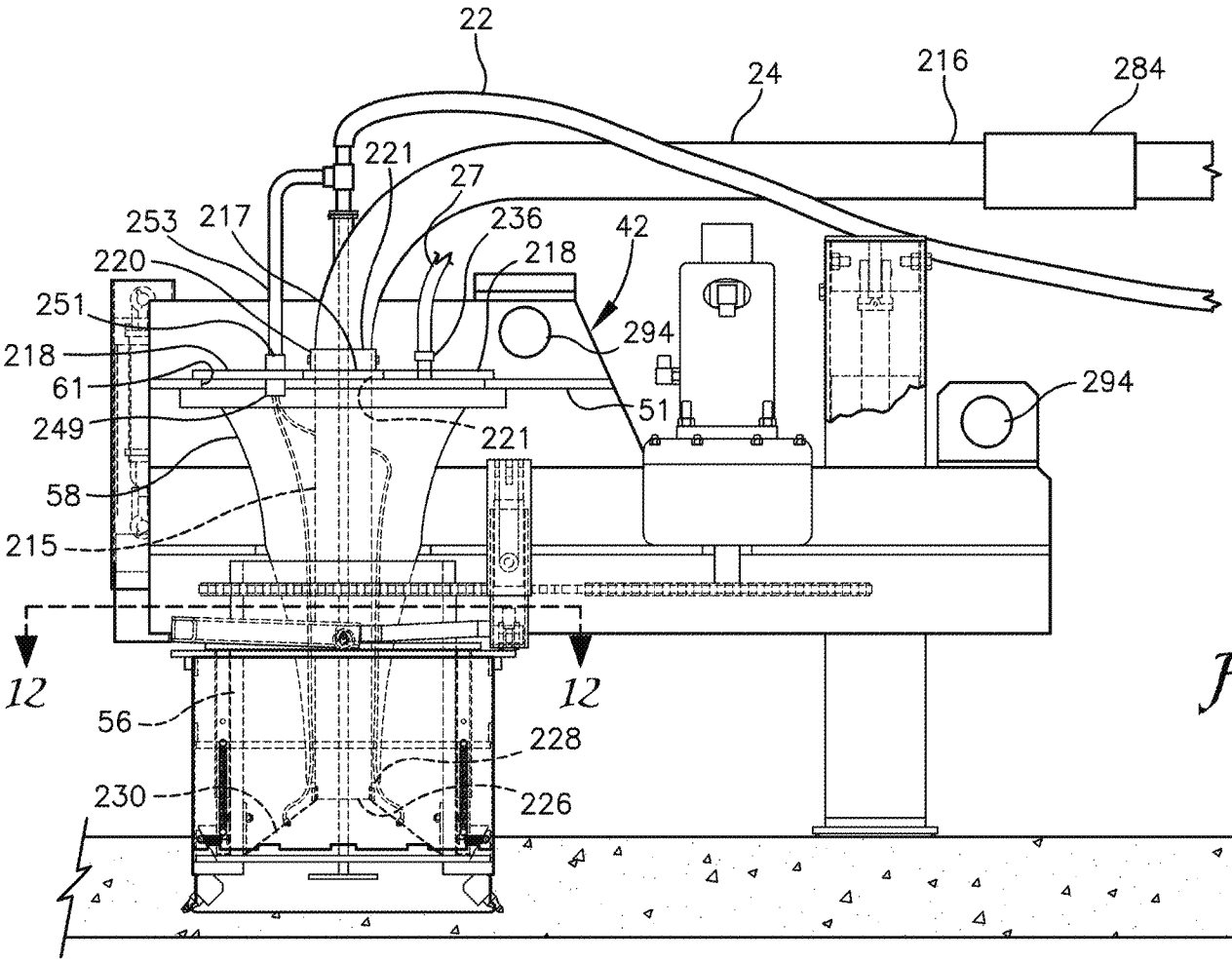
FIG. 7 is a view similar to FIG. 6 showing extendable milling assemblies of an undercutting assembly advanced outward to mill an undercut in the slab.

Referring to FIGS. 7 and 8, water feed line 22 and vacuum line 24 are routed through the hollow axle 58 about which drum 56 rotates. In the embodiment shown, the distal section of the vacuum line 24 is formed from a rigid vacuum tube or pipe 215. Some or most of the rest of the vacuum line 24 is preferably formed from flexible conduit 216 to accommodate movement of the boring machine 10 relative to the truck frame 12. Flexible vacuum conduit 216 and rigid vacuum tube 215 are coupled together by conventional means. Rigid vacuum tube 215 is mounted to and extends through a support plate 217 bolted to the upper surface of the web 51 of upper beam 42 across opening 61 surrounded by axle 58. Additional cover panels or plates 218 may be bolted or otherwise secured to the uppers surface of the web 51 and across opening 61 to cover the opening 61. A mounting sleeve 220 is welded to an upper surface of support plate 217 around an opening 221 extending therethrough. With the milling head 35 removed from the drum 56, rigid vacuum tube 215 may be threaded up through the opening 221 and mounting sleeve 220 and secured in place with set screws 222 extending through threaded receivers in the sleeve 220.

The rigid vacuum tube 215 is positioned relative to the axle 58 so that an open, inlet end 226 is positioned above the milling head 35 when attached to the drum 56. Referring to FIG. 8, the outer diameter of the rigid vacuum tube 215 is smaller than the narrowest inner diameter of axle 58 so that a gap 228 is formed therebetween. A conical flange or partition 230 is mounted on the vacuum tube 215 around the inlet end 226 and extends outward and slopes downward toward an inner surface of the drum 56. A gap 232 may also be formed between the outer circumference of the conical partition 230 and the inner surface of the drum 56. As shown in FIG. 7, an air hose fitting 236 is mounted on the upper surface of a support plate 217 or cover panel 218 around a hole formed therethrough. The compressed air line 27 is connected to the fitting 236 so that compressed air can be directed into the axle 58 and through gap 228 between the axle 58 and rigid vacuum tube 215 and then through gap 232 between conical partition 230 and the inner surface of drum 56 and into a hole 11 formed by the boring machine 10 generally around the outer periphery thereof for drying the hole 11. The air may also function to help cool the milling assemblies 89 and entrain ground material.

In the embodiment shown, the section of the water feed line 22 extending through the axle 58 is also formed from a rigid pipe which may be referred to as rigid water pipe 238. Rigid water pipe 238 extends through a hole formed in the flexible vacuum conduit 216 and generally axially through the rigid vacuum tube 215. The rigid water pipe 238 is connected at its lower end to a manifold 240 (see FIG. 8) mounted on top of and at the intersection of the milling head support arms 187 and 188. A plurality of water supply lines or conduits 241 are connected to and extend between the manifold 240 and nozzles 243 mounted on the milling head support arms 187 and 188 of milling head 235 for spraying water toward or into the path of rotation of the bits 92 of the milling assemblies 289. One or more nozzles 243 may be mounted on each support arm 287 and 288 or nozzles 243 may only be mounted on one of the support arms 287 and 288.

Alternatively or in combination, nozzles 245 may be mounted to the underside of the conical partition 230 for spraying water toward or into the path of rotation of the bits 92 of the milling assemblies 289 and into the hole 11 formed by the boring machine 10. Inlets to the nozzles 245 extend through the partition 230 and water supply tubes 247 extend from the inlets of the nozzles 245, through the gap 228 between the axle 58 and rigid vacuum tube 215 and up to a manifold 249 connected to and below the cover panel 218 or support plate 217. A water supply fitting 251 is mounted on the upper surface of the cover panel and in flow communication with manifold 249 through cover panel 218. A second water supply line 253, which may branch off of water feed line 22, is connected to the water supply fitting 251 on cover panel 218 for supplying water to nozzles 245.

Figure 2:
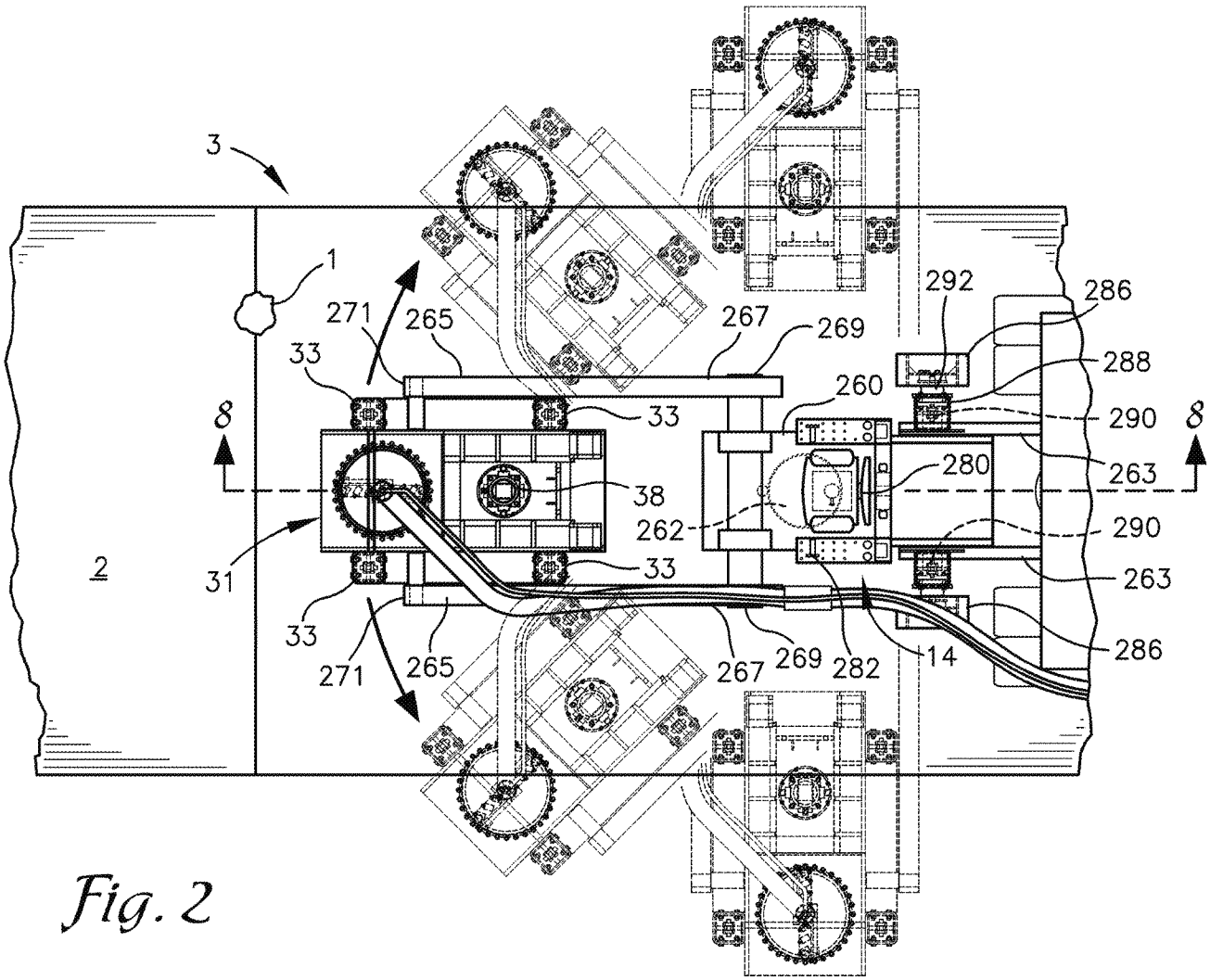
FIG. 2 is an enlarged, top plan view of the pavement boring machine connected to the truck only a portion of which is shown and with selective positioning of the boring machine using the positioning assembly shown in phantom lines.
Figure 13:
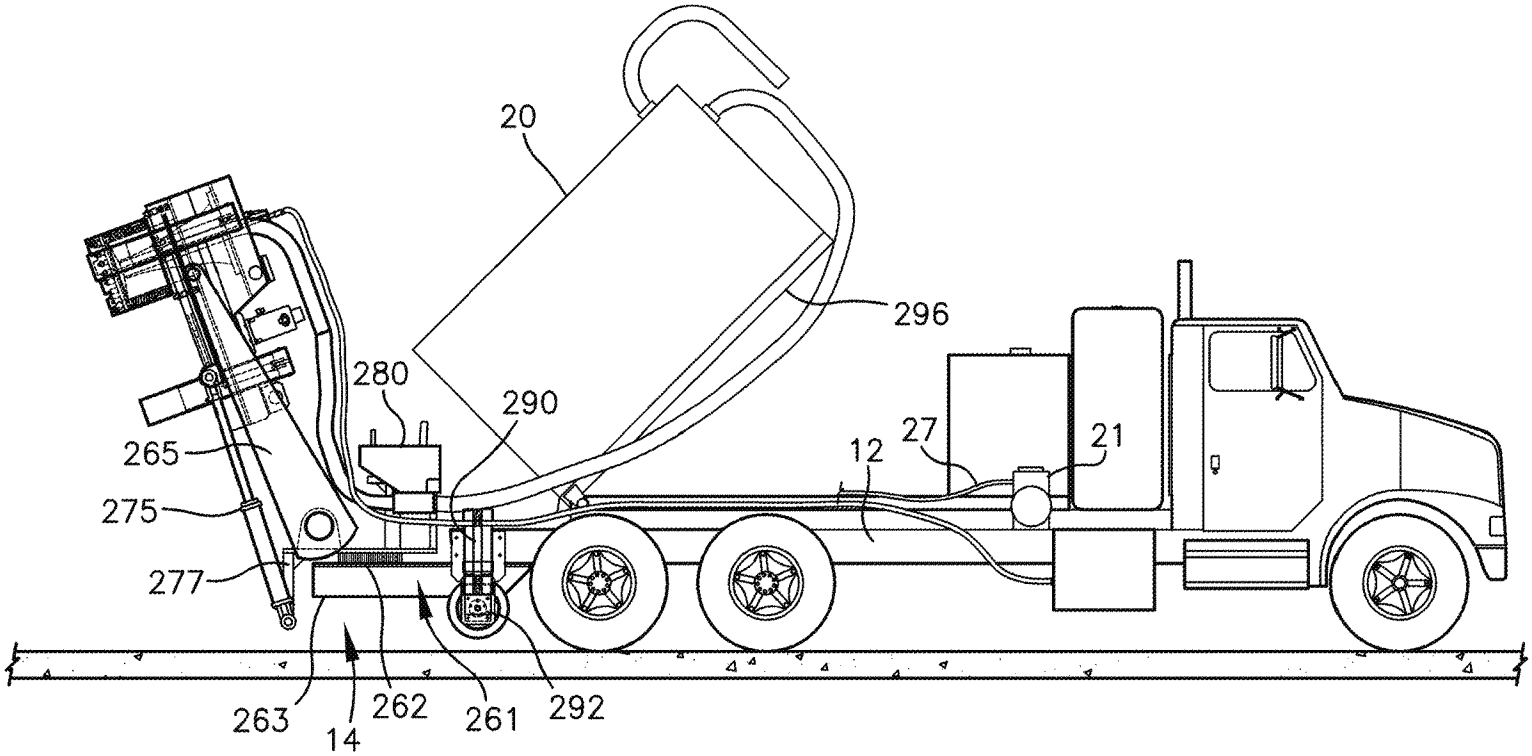
FIG. 13 is a side elevational view of the pavement boring machine connected to the frame of the truck by the positioning assembly and showing the boring machine in a raised position for transport and showing a waste holding tank pivoted upwards for dumping its contents.

Referring to FIGS. 1, 2 and 13, the positioning assembly 14 includes a lift arm support base 260 pivotally connected to a base frame 261 by a turntable 262. Base frame 261 includes two support beams 263 connected to and suspended below the main beams of the truck frame 12. Turntable 262 allows lift arm support base 260 to pivot about a vertical axis. A pair of lift arms 265 are pivotally mounted at their inner ends 267 to the base 260 on opposite sides thereof through pivot bearings 269 and pivot about a horizontal axis. The lift arms 265, when pivoted to a horizontal alignment, extend rearward from the lift arm support base 260 and from the truck frame 12. Distal ends 271 of lift arms 265 are pivotally connected to the main frame 31 by pins projecting outward from main frame 31 on opposite sides thereof. A hydraulic actuator 275 is connected between the lift arm support base 260 and each lift arm 265 for pivoting the lift arms 265 upwards about a horizontal axis to raise and lower the boring machine 10 relative to the truck frame 12. In the embodiment shown, the ends of the actuators 275 connected to the base 260 are pivotally connected to an actuator mount 277 extending downward from the lift arm support base 260.

An operator seat 280 is mounted on and extends above the lift arm support base 260. A control unit or panel 282 may be connected to the seat and operable to raise and lower and pivot the boring machine 10 relative to the truck frame 12 and to control the water pump 18, air compressor 21, vacuum pump 19 as well as any valves or flow control accessories not shown for controlling the delivery of water and air through water feed line 22 and compressed air line 27 or the vacuuming of waste material and water through the vacuum line 24. At least a section 284 of the vacuum line 24 extending proximate the seat 280 is preferably formed from clear or transparent material so that the operator can see whether waste material is being suctioned out of the hole 11 which is indicative that the boring machine 10 is boring into the slab 2.

A drive wheel 286 is connected to each beam of the truck frame 12 on a telescoping support 288. Each telescoping support 288 includes a hydraulic actuator 290 for raising and lowering the respective drive wheel 286 relative to the truck frame 212. A hydraulic motor 292 is also mounted on each telescoping support and drivingly coupled to the respective drive wheel 286. Controls for controlling the operation of the actuators 290 and motors 292 may also be included on or connected to the operator seat 280. When the drive wheels 286 have been lowered to engage the slab 2 on which the truck 13 rests, rotation of the drive wheels 286 is used to move the truck 13 relative to the slab 2 with relatively fine control.

Eyelets or pin receivers 294 (see FIG. 4) may be connected to the main frame 31 of the boring machine 10 and positioned to allow connection of the arm of an excavator or the like to the boring machine 10 as an alternative means for moving the boring machine 10 rather than mounting it to a truck 13 using a positioning assembly 14.

As shown in FIG. 13, the waste holding tank 20 is preferably pivotally mounted relative to the truck frame 12 to permit the contents of the waste holding tank 20 to be dumped. In the embodiment shown, the holding tank 20 is mounted on a tank support frame 296 which is hingedly connected to the truck frame 12 near a rear end thereof. A hydraulic actuator (not shown) connected between the truck frame 12 and the tank support frame 296 is used to pivot the tank support frame 296 and tank 20 relative to the truck frame 12.

In use, and with the lift arms 265 and attached boring machine 10 pivoted upward (as shown in FIG. 13), an operator drives the truck 13 to a section of a road or parking lot or other slab 2 having a pothole 1 therein and drives over and past the pothole 1 to a position in which the boring machine 10, when lowered to extend just above the slab 2, will be located relatively close to the pothole 1. The operator can then move to the operator seat 280 on the positioning assembly 14 and lower the drive wheels 286 to engage the slab 2. The lift arms 265 are lowered to position the lower end of the boring machine in closely spaced relation over the slab 2 as generally shown in FIGS. 3 and 4. With the truck 13 in neutral, the operator can activate the hydraulic motors 292 connected to drive wheels 286 to move the truck 13 longitudinally relative to the slab 2. The lift arm support base 260, lift arms 265 and boring machine 10 may then be pivoted from side to side (as shown in FIG. 2), while moving longitudinally if necessary, to position the milling head 35 and coring bit 36 over and in encircling relation with the pot hole 1.

Before boring begins, the coring bit drive assembly 135 is extended so that the lower end 103 of the coring bit 36 extends approximately axially even with or slightly below the tips of the bits 92 of the milling head milling assemblies 89. In addition, the undercutter actuator assembly 175 is retracted so that the undercutters 157 are pulled inward and do not extend radially outward past the coring bit 36. With the milling head 35 and coring bit 36 centered over the pothole 1, the inner legs 84 of the support legs 33 are extended to engage the slab 2 as generally shown in FIGS. 3 and 4. Motor 38 is engaged to begin rotating drum 56. The water pump 18 is activated and any valves opened or closed as necessary to deliver water through nozzles 243 or 245 or both and the vacuum pump 19 is activated to pull a vacuum through first vacuum line 24. Air compressor 21 may be activated now or later in the process.

The inner legs 84 of the support legs 33 are then extended simultaneously to lower the boring machine 10 relative to the slab 2 so that the teeth 105 of the coring bit 36 begin to cut a circular, smooth sided cut into the slab 2 and the milling heads 35 grind away concrete within the circumferential cut made by the coring bit 36 as generally shown in FIG. 5. The boring machine 10 is continually lowered to continue the cutting and milling process. Ground waste material and water or other coolants sprayed through nozzles 243 and 245 are vacuumed up through the rigid and then flexible vacuum tubes 215 and 216 forming the first vacuum line 24 and delivered to waste holding tank 20. The operator can look through the clear section 284 of the flexible vacuum conduit 216 to confirm that material is being removed. The coring bit 36 encloses milling head 35 to contain debris and slurry and facilitate washing and vacuuming. The coring bit 36 may be a wide variety of diameters including, two, three or four feet in diameter.

If it is only desired for the hole to have a smooth circumference down a distance that is less than the full depth of the hole 11 to be cut, once that distance is reached, the hydraulic pressure acting on the actuator 145 is released allowing the compression springs 128 to hold the coring bit 36 at the depth it has advanced while downward advancement of the rotating drum 56 and fixedly connected milling head 35 continues, as generally shown in FIG. 6, until the desired depth of milling is reached. At that point, the actuator 199 of the undercutter actuator assembly 175 is extended to extend the extendable milling assemblies 161 outward, as generally shown in FIG. 7, such that the bits 92 of the milling assemblies 89 associated therewith extend past the path of rotation of the bits 92 on the outermost milling assemblies 89 on the milling head support arms 187 to form an undercut 157 around the lower end of the hole 11. An undercut of approximately one half inch should suffice for holding a patch in the hold however it is foreseen that undercuts of different depths could be used. Limit switches could be used to limit the depth of cut of the coring bit or to prevent extension of the undercutters when the core bit 36 is in the way.

Once the cutting and milling operation is completed, the operator can continue to spray water and then direct compressed air into the hole to clean and dry the hole to facilitate relatively prompt placement of a patch of uncured concrete or other patch material in the hole 11 formed. The extendable milling assemblies 161 may be retracted by retracting the actuator 199 prior to or after completing the cleaning and drying steps. Once the cleaning and drying steps are completed, and with the extendable milling assemblies 161 retracted, the actuators 86 for inner legs 84 are retracted to raise the drum 56, milling head 35 and coring bit 36 until all are raised above the slab 2 and hole 11 as generally shown in FIG. 8. If not done previously, the coring bit drive assembly 135 may be extended to extend the lower end 103 of the coring bit 36 back to at least the same height as or lower than the tips of the bits 92 of milling assemblies 89 in preparation of boring and milling the next hole 11. The process is then repeated for additional holes.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

I claim:

1. A boring machine for forming a hole in a slab comprising:

a milling assembly including a first plurality of milling bits mounted on a distal end of a rotatable carrier in radially spaced relationship;

a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and an actuator operable to cause said coring bit to slide between a first axial alignment relative to said milling assembly and a second axial alignment relative to said milling assembly while the milling assembly is rotating such that in the second axial alignment a depth of boring by said milling assembly into the slab extends beyond a depth of cutting of said coring bit into the slab.

2. The boring machine as in claim 1 wherein said rotatable carrier is rotatably mounted on an axle.

3. The boring machine as in claim 2 wherein said axle is hollow and open at a distal end and through which a vacuum may be drawn.

4. The boring machine as in claim 2 wherein a vacuum conduit extends through said axle, said vacuum conduit having an open distal end positioned rearward of the first plurality of milling bits.

5. A boring machine comprising:

a milling assembly including a first plurality of milling bits mounted on a distal end of a rotatable carrier in radially spaced relationship;

a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and wherein said coring bit is mounted on a coring bit carrier which is normally biased by at least one spring to slide rearward relative to said rotatable carrier;

said boring machine further including an actuator engaging said coring bit carrier and selectively operable to push the coring bit carrier and the coring bit to slide forward relative to said rotatable carrier and against the biasing force of the at least one spring.

6. A boring machine comprising:

a milling assembly including a first plurality of milling bits mounted on a distal end of a rotatable carrier in radially spaced relationship;

a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and at least one extendable milling bit connected to said rotatable carrier and moveable between a retracted position and an extended position;

in the extended position the path of rotation of said at least one extendable milling bit extends wider than the path of rotation of said at least on extendable milling bit in the retracted position and beyond the path of rotation of said plurality of first milling bits.

7. The boring machine as in claim 6 wherein said at least one extendable milling bit is slidably mounted on a lower end of said rotatable carrier and selectively slidable radially relative to said rotatable carrier.

8. The boring machine as in claim 7 wherein the extent to which said at least one extendable milling bit is slidable radially relative to said rotatable carrier is selectable.

9. The boring machine as in claim 7 further comprising a first spring normally urging said at least one extendable milling bit to the retracted position and an actuator slidably mounted on a periphery of said rotatable carrier and extendable from a retracted position to an extended position, wherein advancement of said actuator to said extended position operates to slidably advance the at least one milling bit to its extended position and advancement of said actuator to said retracted position allows the first spring to advance said at least on extendable milling bit to the retracted position.

10. A boring machine comprising:

a milling assembly including a first plurality of milling bits mounted on a distal end of a rotatable carrier in radially spaced relationship;

a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and at least one extendable milling bit connected to said rotatable carrier and moveable between a retracted position in which a path of rotation of said at least one extendable milling bit extends within a path of rotation of said coring bit and an extended position in which the path of rotation of said at least one extendable milling bit extends beyond the path of rotation of coring bit.

11. A method of repairing a slab having a pothole formed therein comprising:

milling a hole into the slab around the pothole using a milling assembly including a plurality of milling bits while simultaneously cutting a hole around the area cut by the milling assembly with a coring bit by simultaneously urging the milling assembly and the coring bit into the slab while rotating the milling assembly and the coring bit about a common axis;

at a selected depth, continuing urging of the milling assembly into the slab while discontinuing urging of the coring bit into the slab while continuing to rotate at least the milling assembly such that the depth of boring by the milling assembly extends beyond the depth of cutting of the coring bit.

12. The method as in claim 11 wherein the milling assembly includes at least one extendable milling bit connected to said milling assembly and the method further comprises extending the at least one extendable milling bit from a retracted position to an extended position when the milling assembly is extended beyond the selected depth in the slab such that in the extended position the path of rotation of the at least one extendable milling bit extends wider than the path of rotation of the at least on extendable milling bit and the milling assembly with the extendable milling bit in the retracted position so that rotation of the extendable milling bit in the extended position forms an undercut in the hole in spaced relation below an upper surface of the slab in which the hole is formed;

pouring concrete in the hole and leveling the concrete relative to the upper surface of the slab.

13. The method as in claim 11 further comprising the step of:

pulling a vacuum through a conduit extending within the coring bit and having an open end positioned above said milling assembly to remove debris produced from operation of the milling assembly and coring bit.

14. The method as in claim 11 further comprising directing water through nozzles mounted on said milling assembly into the hole formed by said milling assembly.

15. A boring machine comprising:

a support frame slidably mounted on a plurality of support legs;

at least one actuator operable to raise and lower said support frame relative to said plurality of support legs;

an axle connected to said support frame and extending downward relative thereto;

a rotatable carrier rotatably mounted on said axle and rotatable about a central axis of said axle;

a milling assembly including a first plurality of milling bits mounted on a distal end of the rotatable carrier in radially spaced relationship; and a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and an actuator operable to cause said coring bit to slide between a first axial alignment relative to said milling assembly and a second axial alignment relative to said milling assembly while the milling assembly is rotating such that in the second axial alignment a depth of boring by said milling assembly into the slab extends beyond a depth of cutting of said coring bit into the slab.

16. The boring machine as in claim 15 wherein said axle is hollow and open at a distal end and through which a vacuum may be drawn.

17. The boring machine as in claim 15 wherein a vacuum conduit extends through said axle; said vacuum conduit having an open distal end positioned rearward of the first plurality of milling bits.

18. A boring machine comprising:

a support frame slidably mounted on a plurality of support legs;

at least one actuator operable to raise and lower said support frame relative to said plurality of support legs;

an axle connected to said support frame and extending downward relative thereto;

a rotatable carrier rotatably mounted on said axle and rotatable about a central axis of said axle;

a milling assembly including a first plurality of milling bits mounted on a distal end of the rotatable carrier in radially spaced relationship; and a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits;

wherein said coring bit is mounted on a coring bit carrier which is normally biased by at least one spring to slide rearward relative to said rotatable carrier;

said boring machine further including an actuator engaging said coring bit carrier and selectively operable to push the coring bit carrier and the coring bit to slide forward relative to said rotatable carrier and against the biasing force of the at least one spring.

19. A boring machine comprising:

a support frame slidably mounted on a plurality of support legs;

at least one actuator operable to raise and lower said support frame relative to said plurality of support legs;

an axle connected to said support frame and extending downward relative thereto;

a rotatable carrier rotatably mounted on said axle and rotatable about a central axis of said axle;

a milling assembly including a first plurality of milling bits mounted on a distal end of the rotatable carrier in radially spaced relationship; and a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and at least one extendable milling bit connected to said rotatable carrier and moveable between a retracted position and an extended position;

in the extended position the path of rotation of said at least one extendable milling bit extends wider than the path of rotation of said at least on extendable milling bit in the retracted position and beyond the path of rotation of said plurality of first milling bits.

20. The boring machine as in claim 19 wherein said at least one extendable milling bit is slidably mounted on a lower end of said rotatable carrier and slidable radially relative to said rotatable carrier.

21. The boring machine as in claim 20 further comprising a first spring normally urging said at least one extendable milling bit to the retracted position and an actuator slidably mounted on a periphery of said rotatable carrier and extendable from a retracted position to an extended position, wherein advancement of said actuator to said extended positon operates to slidably advance the at least one milling bit to its extended position and advancement of said actuator to said retracted position allows the first spring to advance said at least on extendable milling bit to the retracted position.

22. A boring machine comprising:

a support frame slidably mounted on a plurality of support legs;

at least one actuator operable to raise and lower said support frame relative to said plurality of support legs;

an axle connected to said support frame and extending downward relative thereto;

a rotatable carrier rotatably mounted on said axle and rotatable about a central axis of said axle;

a milling assembly including a first plurality of milling bits mounted on a distal end of the rotatable carrier in radially spaced relationship;

a coring bit slidably connected to said rotatable carrier such that said coring bit rotates with said rotatable carrier and is slidable axially relative to said rotatable carrier, said coring bit having an inner diameter that is greater than the diameter of an area circumscribed upon rotation of said first plurality of milling bits; and at least one extendable milling bit connected to said rotatable carrier and moveable between a retracted position in which a path of rotation of said at least one extendable milling bit extends within a path of rotation of said first coring bit and an extended position in which the path of rotation of said at least one extendable milling bit extends beyond the path of rotation of coring bit.

* * * * *